US010586646B2

(12) United States Patent
Mihara et al.

(10) Patent No.: US 10,586,646 B2
(45) **Date of Patent: *Mar. 10, 2020**

(54) MAGNETIC CORE AND COIL COMPONENT

(71) Applicant: HITACHI METALS, LTD., Tokyo (JP)

(72) Inventors: Toshio Mihara, Minato-ku (JP); Tetsuroh Katoh, Minato-ku (JP); Kazunori Nishimura, Minato-ku (JP); Shin Noguchi, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/333,091

(22) PCT Filed: Sep. 15, 2017

(86) PCT No.: PCT/JP2017/033420

§ 371 (c)(1),
(2) Date: Mar. 13, 2019

(87) PCT Pub. No.: WO2018/052107

PCT Pub. Date: Mar. 22, 2018

(65) Prior Publication Data

US 2019/0272937 A1 Sep. 5, 2019

(30) Foreign Application Priority Data

Sep. 15, 2016 (JP) ..... 2016-180263

(51) Int. Cl.
*H01F 27/29* (2006.01)
*H01F 27/24* (2006.01)
(Continued)

(52) U.S. Cl.
CPC ..... *H01F 27/24* (2013.01); *B22F 1/00* (2013.01); *B22F 1/02* (2013.01); *C22C 38/00* (2013.01);
(Continued)

(58) Field of Classification Search
CPC ..... H01F 27/00–36
(Continued)

(56) References Cited

U.S. PATENT DOCUMENTS 2,873,225 A * 2/1959 Adams ..... H01F 1/14791 148/105
2005/0007232 A1* 1/2005 Ono ..... H01F 1/1475 336/213
(Continued)

FOREIGN PATENT DOCUMENTS

JP 2016-027643 A 2/2016
WO 2006/085609 A1 8/2006
(Continued)

OTHER PUBLICATIONS

International Search Report for PCT/JP2017/033420 dated Dec. 12, 2017 [PCT/ISA/210].
(Continued)

*Primary Examiner* — Tuyen T Nguyen
(74) *Attorney, Agent, or Firm* — Sughrue Mion, PLLC

(57) ABSTRACT

A magnetic core has a high initial permeability and a small core loss, reducing a core loss at high frequencies; and a coil component including the same. This magnetic core is formed by binding a plurality of Fe-based alloy particles containing Al via an oxide layer containing an Fe oxide. In an X-ray diffraction spectrum of the magnetic core measured using Cu-Kα characteristic X-rays, a peak intensity ratio (P1/P2) of peak intensity P1 of a diffraction peak derived from the Fe oxide having a corundum structure appearing in
(Continued)

the vicinity of 2θ=33.2° to peak intensity P2 of a diffraction peak derived from the Fe-based alloy having a bcc structure appearing in the vicinity of 2θ=44.7° is 0.010 or less (excluding 0). A superlattice peak intensity of an $Fe_3Al$ ordered structure is at most a noise level within a range of 2θ=20° to 40°.

5 Claims, 7 Drawing Sheets

(51) Int. Cl.

| | |
|---|---|
| ***H01F 1/055*** | (2006.01) |
| ***H01F 27/28*** | (2006.01) |
| ***H01F 1/33*** | (2006.01) |
| ***B22F 1/00*** | (2006.01) |
| ***H01F 37/00*** | (2006.01) |
| ***H01F 27/255*** | (2006.01) |
| ***B22F 1/02*** | (2006.01) |
| ***C22C 38/00*** | (2006.01) |
| ***H01F 1/24*** | (2006.01) |
| ***H01F 1/147*** | (2006.01) |
| *B22F 3/00* | (2006.01) |

(52) U.S. Cl.
CPC ..... *H01F 1/0551* (2013.01); *H01F 1/147* (2013.01); *H01F 1/24* (2013.01); *H01F 1/33* (2013.01); *H01F 27/255* (2013.01); *H01F 27/2823* (2013.01); *H01F 27/29* (2013.01); *H01F 37/00* (2013.01); *B22F 3/00* (2013.01)

(58) Field of Classification Search
USPC ..... 336/65, 83, 90, 96, 200, 233–234
See application file for complete search history.

(56) References Cited

U.S. PATENT DOCUMENTS

| | | | | |
|---|---|---|---|---|
| 2009/0116991 | A1 | 5/2009 | Okanda | |
| 2015/0332850 | A1 | 11/2015 | Nishio et al. | |
| 2016/0336104 | A1 | 11/2016 | Noguchi et al. | |
| 2017/0178775 | A1* | 6/2017 | Noguchi | B22F 5/00 |
| 2017/0207017 | A1* | 7/2017 | Noguchi | H01F 1/20 |

FOREIGN PATENT DOCUMENTS

| | | | |
|---|---|---|---|
| WO | 2014/112483 | A1 | 7/2014 |
| WO | 2015/108059 | A1 | 7/2015 |

OTHER PUBLICATIONS

International Preliminary Report on Patentability with translation of Written Opinion for International Application No. PCT/JP2017/033420 dated Mar. 19, 2019; 9 pages.

* cited by examiner

IRON Kα1

OXYGEN Kα1

ALUMINUM Kα1

MAGNETIC CORE AND COIL COMPONENT

CROSS REFERENCE TO RELATED APPLICATIONS

This application is a National Stage of International Application No. PCT/JP2017/033420 filed Sep. 15, 2017, claiming priority based on Japanese Patent Application No. 2016-180263 filed Sep. 15, 2016.

TECHNICAL FIELD

The present invention relates to a magnetic core containing a metal-based magnetic powder, and particularly a magnetic core containing an Fe-based alloy powder containing Al as a metal-based magnetic powder, and a coil component including the same.

BACKGROUND ART

Conventionally, coil components such as inductors, transformers, chokes, and motors are used in a wide variety of applications such as home electric appliances, industrial apparatuses, and vehicles. A common coil component includes a magnetic core and a coil wound around the magnetic core in many cases. For such a magnetic core, ferrite is widely used, which is excellent in magnetic properties, a degree of freedom of a shape, and cost merits.

In recent years, as a result of downsizing of power supplies for electronic devices or the like, there has been a strong demand for compact low-profile coil components which can be used even with a large current. Magnetic cores containing a metal-based magnetic powder which has a saturation magnetic flux density higher than that of ferrite are increasingly used.

As the metal-based magnetic powder, Fe—Si-based, Fe—Ni-based, Fe—Si—Cr-based, and Fe—Si—Al-based magnetic alloy powders are used, for example. A magnetic core obtained by consolidating a green compact of the magnetic alloy powder has a high saturation magnetic flux density. But, the magnetic core has low electric resistivity because of the alloy powder. The magnetic alloy powder is previously insulation-coated with water glass or a thermosetting resin or the like in many cases.

Meanwhile, the following technique has also been proposed (see Patent Document 1). Soft magnetic alloy particles containing Al and Cr together with Fe are molded, and then heat-treated in an oxygen-containing atmosphere to form an oxide layer obtained by the oxidation of the alloy particles on the surface of the particles. The soft magnetic alloy particles are bonded via the oxide layer, and insulation properties are imparted to a magnetic core.

PRIOR ART DOCUMENTS

Patent Document

Patent Document 1: International Publication No. 2014/112483

SUMMARY OF THE INVENTION

Problems to be Solved by the Invention

In the meantime, a magnetic core used for a coil component is required to have a small core loss and a high initial permeability. In general, a high initial permeability and a small core loss tend to be provided by increasing the density of a green compact to decrease a void between particles, or by increasing the temperature of a heat treatment to increase the space factor of a magnetic core. However, when a metal-based magnetic powder is formed by consolidation, high-pressure molding may cause the breakage of a mold and restrict the shape of a magnetic core. When a heat treatment temperature is increased, the sintering of the metal-based magnetic powder may proceed, whereby insulation properties are not obtained.

With the practical application of a power semiconductor containing a material such as SiC or GaN, a switching frequency for alternately turning on and off the power semiconductor is increased. Therefore, for a coil component such as a reactor used for a converter, a magnetic core having a small core loss is required even at high frequencies of several hundred kHz to several MHz.

The present invention has been made in view of the above problems, and it is an object of the present invention to provide a magnetic core which has a high initial permeability and a small core loss and can reduce a core loss at high frequencies; and a coil component including the same.

Means for Solving the Problems

A first aspect of the invention is a magnetic core containing Fe-based alloy particles containing Al, wherein: in an X-ray diffraction spectrum of the magnetic core measured using Cu-Kα characteristic X-rays, a peak intensity ratio (P1/P2) of a peak intensity P1 of a diffraction peak of an Fe oxide having a corundum structure appearing in the vicinity of $2\theta=33.2°$ to a peak intensity P2 of a diffraction peak of the Fe-based alloy having a bcc structure appearing in the vicinity of $2\theta=44.7°$ is 0.010 or less (excluding 0); and a superlattice peak intensity of an $Fe_3Al$ ordered structure is equal to or less than a noise level within a range of $2\theta=20°$ to 40°.

In the present invention, it is preferable that the magnetic core has a core loss (30 mT, 300 kHz, 25° C.) of 430 kW/m$^3$ or less, a core loss (10 mT, 5 MHz, 25° C.) of 1100 kW/m$^3$ or less, and an initial permeability of 45 or more.

In the present invention, it is preferable that the Fe-based alloy is represented by a composition formula: aFebAlcCrdSi; and in mass %, $a+b+c+d=100$, $6\leq b<13.8$, $0\leq c\leq 7$, and $0\leq d\leq 1$ are satisfied. Furthermore, it is preferable that $7\leq b\leq 13.5$ is satisfied in Al.

A second aspect of the invention is a coil component including the magnetic core according to the first aspect of the invention and a coil.

Effect of the Invention

The present invention can provide a magnetic core which has a high initial permeability and a small core loss and can reduce a core loss at high frequencies; and a coil component including the same.

MODE FOR CARRYING OUT THE INVENTION

Figure 1A:
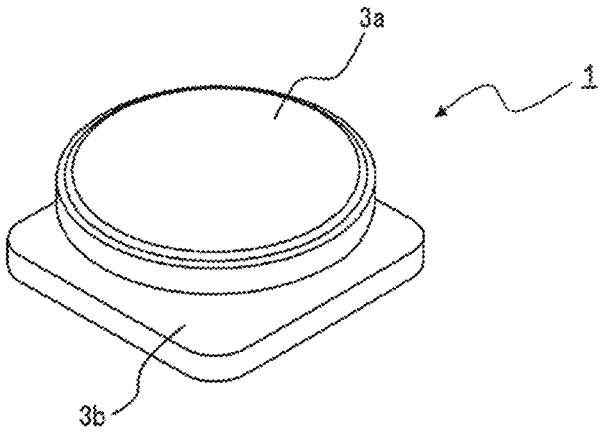
FIG. 1A is a perspective view schematically showing a magnetic core according to an embodiment of the present invention.

Hereinafter, a magnetic core according to an embodiment of the present invention and a coil component including the same will be specifically described. However, the present invention is not limited thereto. Note that components unnecessary for the description are omitted from some or all of the drawings and that some components are illustrated, in an enlarged or reduced manner to facilitate the description. A size, a shape, and a relative positional relationship between constituent members, or the like shown in the description are not limited only to those in the description unless otherwise specified. Furthermore, in the description, the same names and reference numerals designate the same or the identical members, and even if the members are illustrated, the detailed description may be omitted.

Figure 1B:
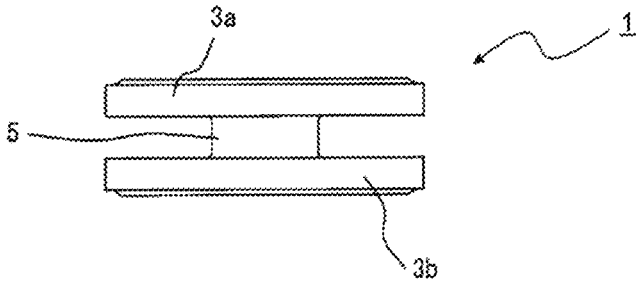
FIG. 1B is a front view schematically showing a magnetic core according to an embodiment of the present invention.

FIG. 1A is a perspective view schematically showing a magnetic core of the present embodiment, and FIG. 1B is a front view thereof. A magnetic core 1 includes a cylindrical conductive wire winding portion 5 for winding a coil and a pair of flange portions 3*a* and 3*b* disposed opposite to both end portions of the conductive wire winding portion 5. The magnetic core 1 has a drum type appearance. The cross-sectional shape of the conductive wire winding portion 5 is not limited to a circular shape, and any shape such as a square shape, a rectangular shape, or an elliptical shape may be employed. The flange portion may be disposed on each of both the end portions of the conductive wire winding portion 5, or may be disposed on only one end portion. Note that the illustrated shape examples show one form of the magnetic core configuration, and the effects of the present invention are not limited to the illustrated configuration.

The magnetic core according to the present invention is formed by a heat treated product of Fe-based alloy particles, and is configured as an aggregate in which a plurality of Fe-based alloy particles containing Al are bonded via an oxide layer containing an Fe oxide. The Fe oxide is an oxide formed through the oxidation of an Fe-based alloy and derived from an Fe-based alloy, and is present at a grain boundary between the Fe-based alloy particles and on the surface of the magnetic core and functions as an insulating layer which separates the particles. The surface of the magnetic core is confirmed by the diffraction peak of an Fe oxide having a corundum structure appearing in the vicinity of 2θ=33.2° in an X-ray diffraction spectrum measured using Cu-Kα characteristic X-rays to be described below.

In the present invention, in an X-ray diffraction spectrum of the magnetic core, a peak intensity ratio (P1/P2) of a peak intensity P1 of a diffraction peak of the Fe oxide appearing in the vicinity of 2θ=33.2° to a peak intensity P2 of a diffraction peak of the Fe-based alloy having a bcc structure appearing in the vicinity of 2θ=44.7° which is the diffraction maximum intensity in the X-ray diffraction spectrum is 0.010 or less (excluding 0). When the superlattice peak of an $Fe_3Al$ ordered structure is confirmed in the X-ray diffraction spectrum, the core loss of the magnetic core is increased even if the peak intensity ratio (P1/P2) is 0.010 or less, thus the peak intensity of the superlattice peak of the $Fe_3Al$ ordered structure within a range of 2θ=20° to 40° is equal to or less than a noise level.

The peak intensity ratio (P1/P2) of the X-ray diffraction is obtained by analyzing the magnetic core according to the X-ray diffraction method (XRD), and measuring the peak intensity P1 of the Fe oxide (104 plane) and the diffraction peak intensity P2 of the Fe-based alloy (110 plane) having a bcc structure. A diffraction intensity is smoothed for a diffraction angle 2θ=20 to 110° using the Cu-Kα characteristic X-rays, and the background is removed, to obtain respective peak intensities.

In the present invention, the Fe oxide, the Fe-based alloy having a bcc structure, and the superlattice having an $Fe_3Al$ ordered structure are measured using an X-ray diffraction apparatus, and confirmed according to identification using JCPDS (Joint Committee on Powder Diffraction Standards) cards from the obtained X-ray diffraction charts. The Fe oxide can be identified as $Fe_2O_3$ according to JCPDS card: 01-079-1741 from the diffraction peak. The Fe-based alloy having a bcc structure can be identified as bcc-Fe according to JCPDS card: 01-071-4409. The superlattice peak having an $Fe_3Al$ ordered structure can be identified as $Fe_3Al$ according to JCPDS card: 00-050-0955. Since the angle of the diffraction peak includes an error such as fluctuation with respect to the data of the JCPDS card due to the solid solution of an element or the like, a case of a diffraction peak angle (2θ) extremely close to each JCPDS card is defined as "vicinity". Specifically, the diffraction peak angle (2θ) of the Fe oxide is in the range of 32.9° to 33.5°; the diffraction peak angle (2θ) of the Fe-based alloy having a bcc structure is 44.2° to 44.8°; and the diffraction peak angle (2θ) of $Fe_3Al$ is 26.3° to 26.9°.

In the present invention, the magnetic core is obtained, which has excellent magnetic properties including a core loss (30 mT, 300 kHz, 25° C.) of 430 kW/$m^3$ or less, a core loss (10 mT, 5 MHz, 25° C.) of 1100 kW/$m^3$ or less, and an initial permeability of 45 or more.

Here, in the X-ray diffraction spectrum, the fact that the peak intensity of the diffraction peak is equal to or less than the noise level means that the intensity of the diffraction peak is equal to the noise level forming the base line (X-ray scattering obtained in an unavoidable manner), or less than the noise level, which is difficult to detect the diffraction peak and cannot confirm the diffraction peak.

In the present invention, the Fe-based alloy contains Al. The Fe-based alloy may further contain: Cr from the viewpoint of corrosion resistance; and Si in anticipation of improvement of magnetic properties, or the like. The Fe-based alloy may contain impurities mixed from a raw material or a process. The composition of the Fe-based alloy of the present invention is not particularly limited as long as it can constitute the magnetic core from which conditions such as the aforementioned peak intensity ratio (P1/P2) are obtained.

Preferably, the Fe-based alloy is represented by a composition formula: aFebAlcCrdSi, and in mass %, a+b+c+d=100, 6≤b<13.8, 0≤c≤7, and 0≤d≤1 are satisfied.

Al is an element for improving corrosion resistance or the like, and contributes to the formation of an oxide provided by a heat treatment to be described later. In addition, from the viewpoint of contributing to the reduction of crystal magnetic anisotropy, the content of Al in the Fe-based alloy is 6.0 mass % or more. A too small content of Al causes an insufficient effect of reducing the crystal magnetic anisotropy, which does not provide an effect of improving the core loss. The Al amount is more preferably 7 mass % or more.

Meanwhile, a too large content of Al may cause a decreased saturation magnetic flux density and a precipitated $Fe_3Al$ phase in the structure of the Fe-based alloy, so that the effect of improving the core loss is not obtained in some cases.

In R. C. Hall J. Appl. Phys. 30, 816 (1959), FIG. 1 discloses an anisotropy constant of the composition of an FeAl alloy. According to the disclosure, the anisotropy constant decreases as the amount of Al increases according to the balance with Fe, and Al has an extreme value in the vicinity of 15 mass %. It can be said that, since the coercive force of the alloy is proportional to the anisotropy constant, the Al amount is preferably about 15 mass % in order to reduce hysteresis loss. Meanwhile, the FeAl alloy is known to produce $Fe_3Al$ in a composition in the vicinity of bal. Fe 25 at. % Al as a stoichiometric composition (bal. Fe 13.8 Al in mass %). Conventionally, it has been known that the formation of $Fe_3Si$ or $Fe_3Al$ having a $DO_3$ type ordered structure in Fe—Si, Fe—Al, and Fe—Si—Al alloys improves a permeability, but in the investigation by the present inventors, it was found that the core loss increases when the superlattice peak of the $Fe_3Al$ ordered structure is confirmed even if the peak intensity ratio (P1/P2) is satisfied. Accordingly, the stoichiometric composition in the binary composition of Fe and Al as the composition of the Fe-based alloy is preferably avoided to select a composition which is less likely to form the $Fe_3Al$ ordered structure, with the content of Al being less than 13.8 mass %. Furthermore, the content of Al is preferably 13.5 mass % or less.

Cr is an optional element, and may be contained as an element for improving the corrosion resistance of the alloy in the Fe-based alloy. Cr is useful for bonding the Fe-based alloy particles via an oxide layer of the Fe-based alloy in a heat treatment to be described later. From this viewpoint, the content of Cr in the Fe-based alloy is preferably 0 mass % or more and 7 mass % or less. A too large amount of Al or Cr causes a decreased saturation magnetic flux density, and a hard alloy. Therefore, the total content of Cr and Al is more preferably 18.5 mass % or less. The content of Al is preferably more than that of Cr so as to facilitate the formation of an oxide layer having a high Al ratio.

The balance of the Fe-based alloy other than Al, and Cr if necessary, is mainly composed of Fe, but the Fe-based alloy can also contain other element as long as it exhibits an advantage such as improvement in formability or magnetic properties. However, it is preferable that, since a nonmagnetic element lowers a saturation magnetic flux density or the like, the content of the other element is 1.5 mass % or less in the total amount of 100 mass %.

For example, in a general refining step of an Fe-based alloy, Si is usually used as a deoxidizer to remove oxygen (O) which is an impurity. The added Si is separated as an oxide, and removed during the refining step, but a part thereof remains, and is contained in an amount of about 0.5 mass % or less as an unavoidable impurity in the alloy in many cases. A highly-pure raw material can be used and subjected to vacuum melting or the like to refine the highly-pure raw material, but the highly-pure raw material causes poor mass productivity, which is not preferable from the viewpoint of cost. If the particles contain a large amount of Si, the particles become hard. Meanwhile, when an amount of Si is contained, an initial permeability can be increased, and a core loss can be reduced in some cases as compared with the case where Si is not contained. In the present invention, Si of 1 mass % or less may be contained. The range of the amount of Si is set in not only a case where Si is present as an inevitable impurity (typically, 0.5 mass % or less) but also a case where a small amount of Si is added.

The Fe-based alloy may contain, for example, Mn≤1 mass %, C≤0.05 mass %, Ni≤0.5 mass %, N≤0.1 mass %, P≤0.02 mass %, S≤0.02 mass % as inevitable impurities or the like. The amount of O contained in the Fe-based alloy is preferably as small as possible, and more preferably 0.5 mass % or less. All of the composition amounts are also values when the total amount of Fe, Al, Cr, and Si is 100 mass %.

The average particle diameter of the Fe-based alloy particles (here, a median diameter d50 in cumulative particle size distribution is used) is not particularly limited, but by decreasing the average particle diameter, the strength and high frequency characteristics of the magnetic core are improved. For example, in applications requiring the high frequency characteristics, the Fe-based alloy particles having an average particle size of 20 μm or less can be suitably used. The median diameter d50 is more preferably 18 μm or less, and still more preferably 16 μm or less. Meanwhile, when the average particle size is small, the permeability is low, and the specific surface area is large, which facilitates oxidation, so that the median diameter d50 is preferably 5 μm or more. Coarse particles are more preferably removed from the Fe-based alloy particles by using a sieve or the like. In this case, it is preferable to use at least alloy particles of less than 32 μm (that is, passing through a sieve having an opening of 32 μm).

The form of the Fe-based alloy particles is not particularly limited, but from the viewpoint of fluidity or the like, it is preferable to use a granular powder typified by an atomized powder as a raw material powder. An atomization method such as gas atomization or water atomization is suitable for preparing an alloy powder which has high malleability and ductility and is hard to be pulverized. The atomization method is also suitable for obtaining a substantially spherical soft magnetic alloy powder. The pulverizing method of the atomization method is not particularly limited, and a rotary disc atomization method in which a high pressure gas (several MPa) is injected (primary pulverizing) onto a molten metal, and droplets are then caused to collide against a rotating disc (secondary pulverizing) for pulverizing, and a high pressure water atomization method in which high pressure water (several tens MPa to one hundred and several tens MPa) is injected onto a molten metal for pulverizing, or the like can be suitably employed.

A method of manufacturing a magnetic core of the present embodiment includes the steps of: molding an Fe-based alloy powder to obtain a green compact (green compact forming step); and heat treating the green compact to form the oxide layer (heat treating step).

In the green compact forming step, a binder is preferably added to the Fe-based alloy powder in order to bind Fe-based alloy particles to each other when the particles are pressed, and to impart a strength to withstand handling after molding to the green compact. The kind of the binder is not particularly limited, but various organic binders such as polyethylene, polyvinyl alcohol, and an acrylic resin can be used, for example. The organic binder is thermally decomposed by a heat treatment after molding. Therefore, an inorganic binder such as a silicone resin, which solidifies and remains even after the heat treatment or binds powders as Si oxides, may be used together.

The amount of the binder to be added may be such that the binder can be sufficiently spread between the Fe-based alloy particles to ensure a sufficient green compact strength. Meanwhile, the excessive amount of the binder decreases the density and the strength. From such a viewpoint, the amount of the binder to be added is preferably 0.5 to 3.0 parts by weight based on 100 parts by weight of the Fe-based alloy having an average particle diameter of 10 μm, for example. However, in the method of manufacturing a magnetic core according to the present embodiment, the oxide layer formed in the heat treatment step exerts the action of bonding the Fe-based alloy particles to each other, whereby the use of the inorganic binder is preferably omitted to simplify the step.

The method of mixing the Fe-based alloy particles and the binder is not particularly limited, and conventionally known mixing methods and mixers can be used. In the mixed state of the binder, the mixed powder is an agglomerated powder having a broad particle size distribution due to its binding effect. By causing the mixed powder to pass through a sieve using, for example, a vibration sieve or the like, a granulated powder having a desired secondary particle size suitable for molding can be obtained. A lubricant such as stearic acid or a stearic acid salt is preferably added in order to reduce friction between the powder and a mold during pressing. The amount of the lubricant to be added is preferably 0.1 to 2.0 parts by weight based on 100 parts by weight of the Fe-based alloy particles. The lubricant can also be applied to the mold.

Next, the resultant mixed powder is pressed to obtain a green compact. The mixed powder obtained by the above procedure is suitably granulated as described above, and is subjected to a pressing step. The granulated mixed powder is pressed to a predetermined shape such as a toroidal shape or a rectangular parallelepiped shape using a pressing mold. The pressing may be room temperature molding or warm molding performed during heating such that a binder does not disappear. The molding pressure during pressing is preferably 1.0 GPa or less. The molding at a low pressure allows to realize a magnetic core having high magnetic properties and a high strength while suppressing the breakage or the like of the mold. The preparation and molding methods of the mixed powder are not limited to the above pressing.

Next, a heat treatment step of heat-treating the green compact obtained through the green compact forming step will be described. In order to form the oxide layer between the Fe-based alloy particles, the green compact is subjected to a heat treatment (high-temperature oxidation) to obtain a heat treated product. Such a heat treatment allows to alleviate stress distortion introduced by molding or the like. This oxide layer is obtained by reacting the Fe-based alloy particles with oxygen (O) by a heat treatment to grow the Fe-based alloy particles, and is formed by an oxidation reaction exceeding the natural oxidation of the Fe-based alloy. The oxide layer covers the surface of the Fe-based alloy particles, and furthermore voids between the particles are filled with the oxide layer. The heat treatment can be performed in an atmosphere in which oxygen is present, such as in the air or in a mixed gas of oxygen and an inert gas. The heat treatment can also be performed in an atmosphere in which water vapor is present, such as in a mixed gas of water vapor and an inert gas. Among them, the heat treatment in the air is simple, which is preferable. In this oxidation reaction, in addition to Fe, Al having a high affinity for O is also released, to form an oxide between the Fe-based alloy particles. When Cr or Si is contained in the Fe-based alloy, Cr or Si is also present between the Fe-based alloy particles, but the affinity of Cr or Si with O is smaller than that of Al, whereby the amount of Cr or Si is likely to be relatively smaller than that of Al.

The heat treatment in the present step may be performed at a temperature at which the oxide layer or the like is formed, but the heat treatment is preferably performed at a temperature at which the Fe-based alloy particles are not significantly sintered. By the necking of the alloys due to the significant sintering, a part of the oxide layer is surrounded by the alloy particles to be isolated in an island form. For this reason, the function as an insulating layer separating the particles is deteriorated. Since the amount of the oxide of Fe is influenced by the heat treatment temperature, the specific heat treatment temperature is preferably in the range of 650 to 800° C. A holding time in the above temperature range is appropriately set depending on the size of the magnetic core, the treated amount, the allowable range of characteristic variation or the like, and is set to 0.5 to 3 hours, for example.

The space factor of the magnetic core may be 80% or more. If the space factor is less than 80%, a desired initial permeability may not be obtained.

Figure 2A:
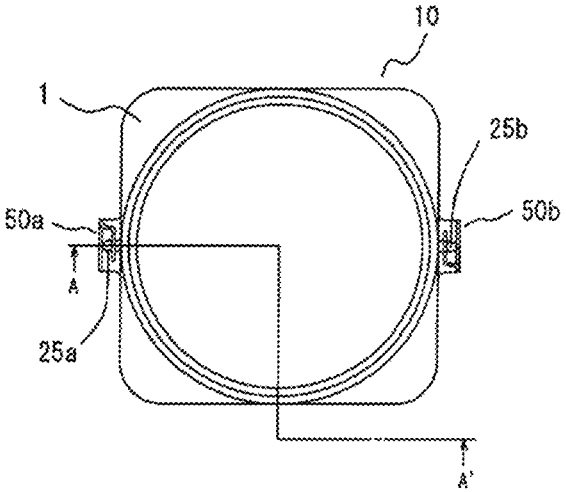
FIG. 2A is a plan view schematically showing a coil component according to an embodiment of the present invention.
Figure 2B:
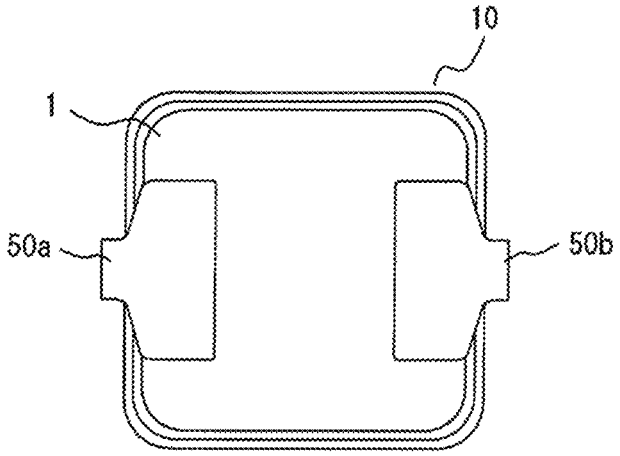
FIG. 2B is a bottom view schematically showing a coil component according to an embodiment of the present invention.
Figure 2C:
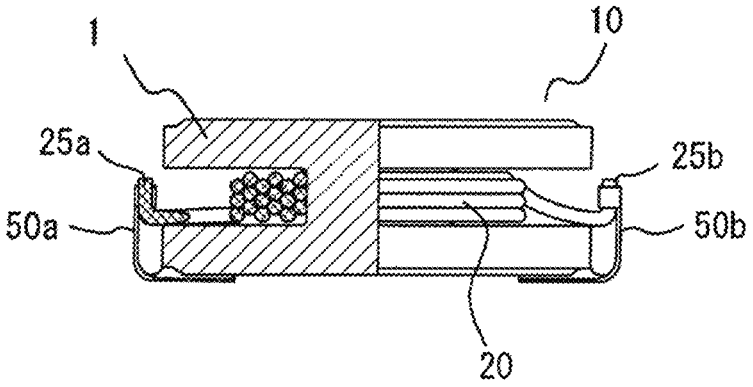
FIG. 2C is a partial cross-sectional view taken along line A-A' in FIG. 2A.

FIG. 2A is a plan view schematically showing the coil component of the present embodiment. FIG. 2B is a bottom view thereof. FIG. 2C is a partial cross-sectional view taken along line A-A' in FIG. 2A. A coil component 10 includes a magnetic core 1 and a coil 20 wound around a conductive wire winding portion 5 of the magnetic core 1. On a mounting surface of a flange portion 3*b* of the magnetic core 1, each of metal terminals 50*a*, 50*b* is provided on each of edge portions symmetrically located to the center of gravity interposed therebetween, and a free end portion of one of the metal terminals 50*a*, 50*b* protruding from the mounting surface rises at right angles to the height direction of the magnetic core 1. The rising free end portions of the metal terminals 50*a*, 50*b* and end portions 25*a*, 25*b* of the coil are respectively joined to each other to establish electrical connection therebetween. Such a coil component having the magnetic core and the coil is used as, for example, a choke, an inductor, a reactor, and a transformer, or the like.

The magnetic core may be manufactured in the form of a single magnetic core obtained by pressing only a soft magnetic alloy powder mixed with a binder or the like as described above, or may be manufactured in a form in which a coil is disposed in the magnetic core. The latter configuration is not particularly limited, and can be manufactured in the form of a magnetic core having a coil-enclosed structure using a method of integrally pressing a soft magnetic alloy powder and a coil, or a lamination process such as a sheet lamination method or a printing method, for example.

Examples

Hereinafter, preferred examples of the present invention will be demonstratively described in detail. In the description, an Fe—Al—Cr-based alloy is used as an Fe-based alloy. However, materials and blend amounts or the like described in Examples are not intended to limit the scope of the present invention only to those in the description unless the materials and the blend amounts or the like are particularly limitedly described.

(1) Preparation of Raw Material Powder

A raw material powder of an Fe-based alloy was prepared by an atomizing method. The composition analysis results are shown in Table 1. Raw material powders A to D were produced by an atomizing apparatus according to a rotating disc method, and raw material powders E to L were prepared by a high pressure water atomizing apparatus.

TABLE 1

| Raw material powder | Manufacturing method* | Component (mass %) | | | | | | | | |
|---|---|---|---|---|---|---|---|---|---|---|
| | | Fe | Al | Cr | Si | O | C | P | S | N |
| A | Rotation | bal | 2.01 | 3.90 | 0.20 | 0.20 | 0.004 | Unmeasured | Unmeasured | 0.038 |
| B | Rotation | bal | 5.05 | 4.04 | 0.20 | 0.19 | 0.007 | 0.007 | 0.002 | 0.010 |
| C | Rotation | bal | 9.86 | 3.93 | 0.21 | 0.16 | 0.009 | Unmeasured | Unmeasured | Unmeasured |
| D | rotation | bal | 14.38 | 4.12 | 0.20 | 0.20 | 0.010 | 0.015 | 0.001 | 0.004 |
| E | High pressure water | bal | 7.62 | 3.99 | 0.22 | 0.39 | 0.012 | 0.007 | 0.001 | 0.004 |
| F | High pressure water | bal | 4.85 | 4.01 | 0.20 | 0.50 | 0.019 | 0.009 | 0.002 | 0.003 |
| G | High pressure water | bal | 7.04 | 3.95 | 0.20 | 0.59 | 0.011 | 0.005 | 0.001 | 0.005 |
| H | High pressure water | bal | 8.09 | 3.96 | 0.20 | 0.45 | 0.010 | 0.007 | 0.001 | 0.002 |
| I | High pressure water | bal | 8.29 | 2.98 | 0.20 | 0.37 | 0.006 | 0.006 | 0.001 | 0.002 |
| J | High pressure water | bal | 10.10 | 3.98 | 0.20 | 0.39 | 0.009 | 0.006 | 0.001 | 0.001 |
| K | High pressure water | bal | 11.62 | 3.92 | 0.20 | 0.45 | 0.012 | 0.010 | 0.004 | 0.001 |
| L | High pressure water | bal | 8.36 | 4.93 | 0.20 | 0.45 | 0.005 | 0.006 | 0.001 | 0.003 |

*"Rotation" in manufacturing method represents an atomizing apparatus according to a rotating disc method, and "high pressure water" represents a high pressure water atomizing apparatus.

For each analytical value, Al is analyzed by an ICP emission spectrometry method; Cr, a capacitance method; Si and P, an absorptiometric method; C and S, a combustion-infrared adsorption method, O, an inert gas melting-infrared absorption method; and N, an inert gas melting-thermal conductivity method. The contents of O, C, P, S and N were confirmed, and were less than 0.05 mass % based on 100 mass % of Fe, Al, Cr and Si.

The average particle diameter (median diameter d50), 10 volume % particle diameter (d10), and 90 volume % particle diameter (d90) of the raw material powder were obtained by a laser diffraction scattering type particle size distribution measuring apparatus (LA-920, manufactured by Horiba, Ltd.). A BET specific surface area was obtained according to a gas adsorption method using a specific surface area measuring apparatus (Macsorb, manufactured by Mountech). The saturation magnetization Ms and coercive force He of each of the raw material powders were obtained by a VSM magnetic property measuring apparatus (VSM-5-20, manufactured by Toei Kogyo Co., Ltd.). In measurement, a capsule was filled with the raw material powder, and a magnetic field (10 kOe) was applied thereto. The saturation magnetic flux density Bs was calculated from the saturation magnetization Ms according to the following formula.

$$\text{Saturation Magnetic Flux Density } Bs(T)=4\pi\times Ms\times\rho_t\times 10^{-4}$$

($\rho_t$: true density of Fe-based alloy)

The true density $\rho_t$ of the Fe-based alloy was obtained by measuring an apparent density from each of ingots of alloys providing raw material powders A to L according to a liquid weighing method. Specifically, ingots cast with Fe-based alloy compositions of the raw material powders A to L and having an outer diameter of 30 mm and a height of 200 mm were cut to have a height of 5 mm by a cutting machine, to obtain samples, and the samples were evaluated. The measurement results are shown in Table 2.

TABLE 2

| Raw material powder | Particle diameter d10 (μm) | d50 (μm) | d90 (μm) | Specific surface area ($m^2/g$) | Hc (A/m) | Ms (emu/g) | Bs (T) |
|---|---|---|---|---|---|---|---|
| A | 4.4 | 12.3 | 24.3 | 0.20 | 1010 | 190 | 1.8 |
| B | 4.1 | 12.6 | 26.0 | 0.25 | 941 | 180 | 1.7 |
| C | 4.6 | 13.0 | 27.2 | 0.28 | 854 | 159 | 1.4 |
| D | 4.2 | 11.7 | 22.8 | 0.35 | 632 | 120 | 1.0 |
| E | 4.6 | 13.1 | 24.8 | 0.30 | 1077 | 170 | 1.5 |
| F | 4.6 | 12.8 | 26.5 | 0.31 | 1075 | 183 | 1.7 |
| G | 4.2 | 12.3 | 26.6 | 0.36 | 1092 | 174 | 1.5 |
| H | 4.0 | 11.5 | 25.7 | 0.35 | 1012 | 169 | 1.5 |
| I | 4.1 | 12.0 | 28.8 | 0.36 | 1118 | 173 | 1.5 |
| J | 4.0 | 11.9 | 26.1 | 0.36 | 970 | 159 | 1.4 |
| K | 4.2 | 11.2 | 24.0 | 0.36 | 951 | 149 | 1.3 |
| L | 4.0 | 12.3 | 28.6 | 0.36 | 1048 | 164 | 1.4 |

(2) Preparation of Magnetic Core

A magnetic core was prepared as follows. Into each of the A to L raw material powders, PVA (Poval PVA-205, manufactured by KURARAY CO., LTD., solid content: 10%) as a binder and ion-exchanged water as a solvent were charged, followed by stirring and mixing to prepare a slurry. The concentration of the slurry was 80 mass %. The amount of the binder was 0.75 parts by weight based on 100 parts by weight of the raw material powder. The resultant mixed powder was spray dried by a spray drier, and the dried mixed powder was caused to pass through a sieve to obtain a granulated powder. To this granulated powder, zinc stearate was added at a ratio of 0.4 parts by weight based on 100 parts by weight of the raw material powder, followed by mixing.

The resultant granulated powder was pressed at room temperature by using a press machine to obtain a toroidal (circular ring)-shaped green compact and a disc-shaped green compact as a sample for X-ray diffraction intensity measurement. This green compact was placed in a heat treatment furnace, heated at 250° C./h in the air, and subjected to a heat treatment held at a heat treatment temperature of 670° C. to 870° C. for 45 minutes to obtain a magnetic core. The magnetic core had an outside size including an outer diameter of 13.4 mm, an inner diameter of 7.7 mm, and a height of 2.0 mm. As the magnetic core for X-ray diffraction intensity measurement, a sample having an outer diameter of 13.5 mm and a height of 2.0 mm was used.

(3) Evaluation Method and Results

Figure 3:
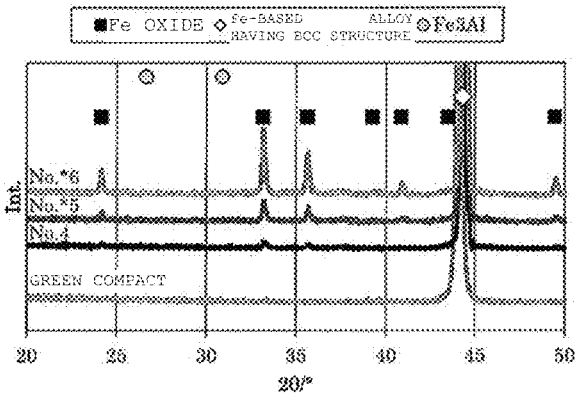
FIG. 3 is a view for illustrating X-ray diffraction spectra of Samples No. 4 to No. *6 prepared in Examples.
Figure 4:
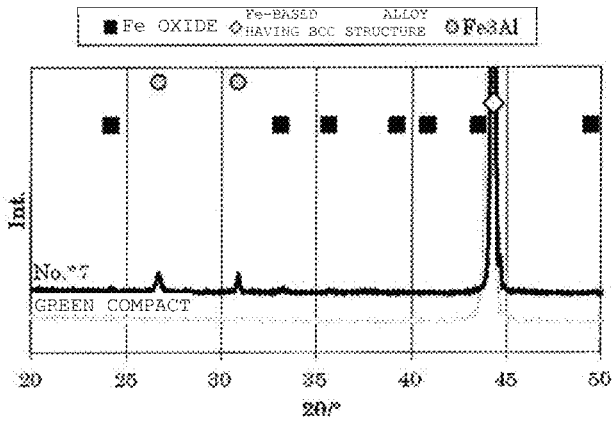
FIG. 4 is a view for illustrating an X-ray diffraction spectrum of Sample No. *7 prepared in Examples.
Figure 5A:
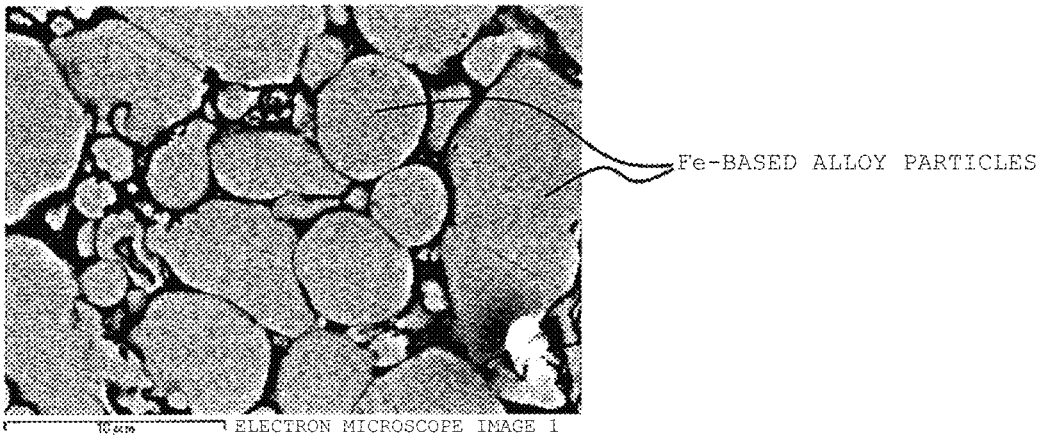
FIG. 5A is an SEM image of a cross section of a magnetic core of Sample No. 4 prepared in Examples.
Figure 5B:
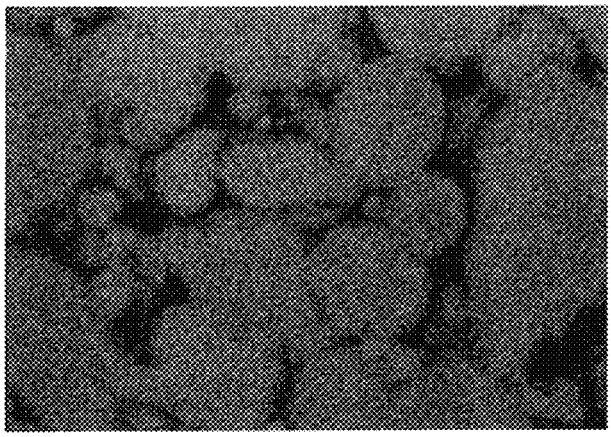
FIG. 5B is an SEM image of a cross section of a magnetic core of Sample No. 4 prepared in Examples.
Figure 5C:
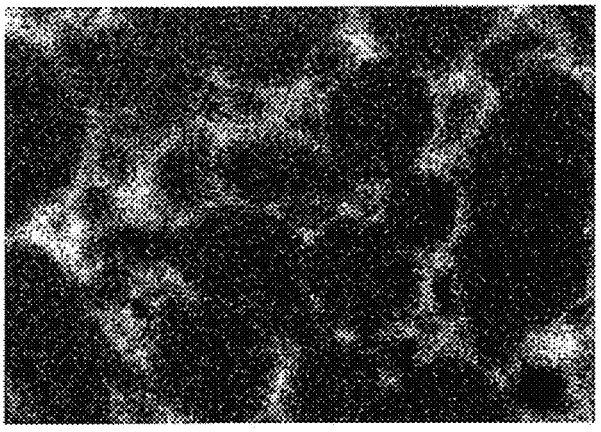
FIG. 5C is an SEM image of a cross section of a magnetic core of Sample No. 4 prepared in Examples.
Figure 5D:
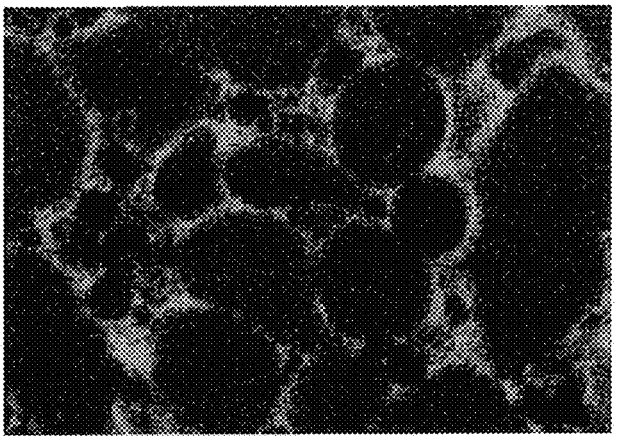
FIG. 5D is an SEM image of a cross section of a magnetic core of Sample No. 4 prepared in Examples.
Figure 6:
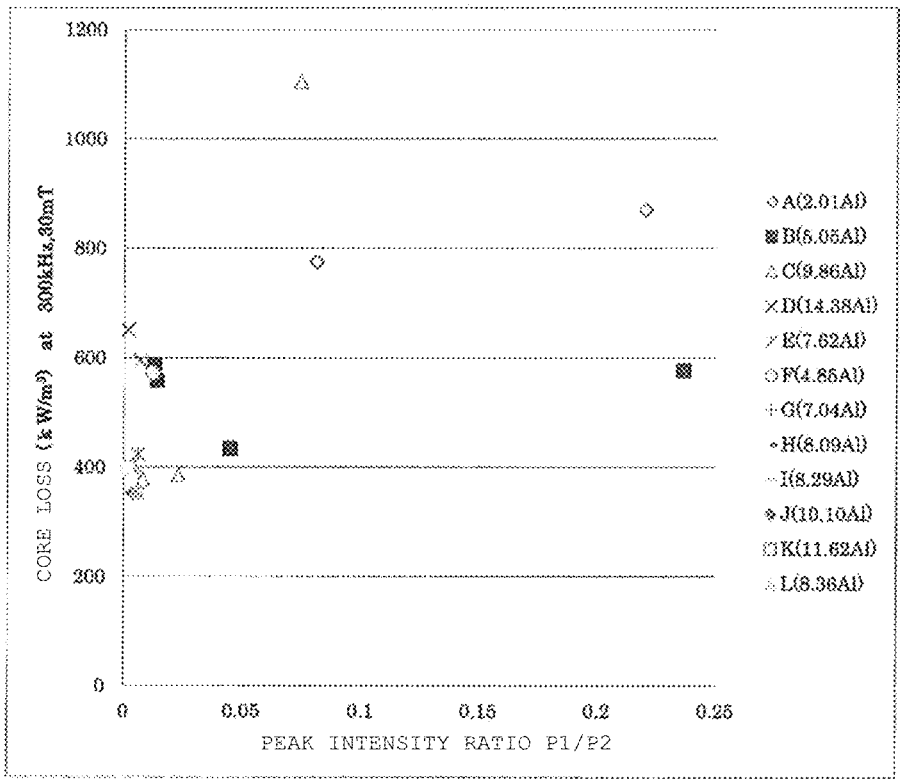
FIG. 6 is a plot view of a core loss (30 mT, 300 kHz, 25° C.) with respect to a peak intensity ratio of a magnetic core of each of Samples No. *1 to No. *21 prepared in Examples.
Figure 7:
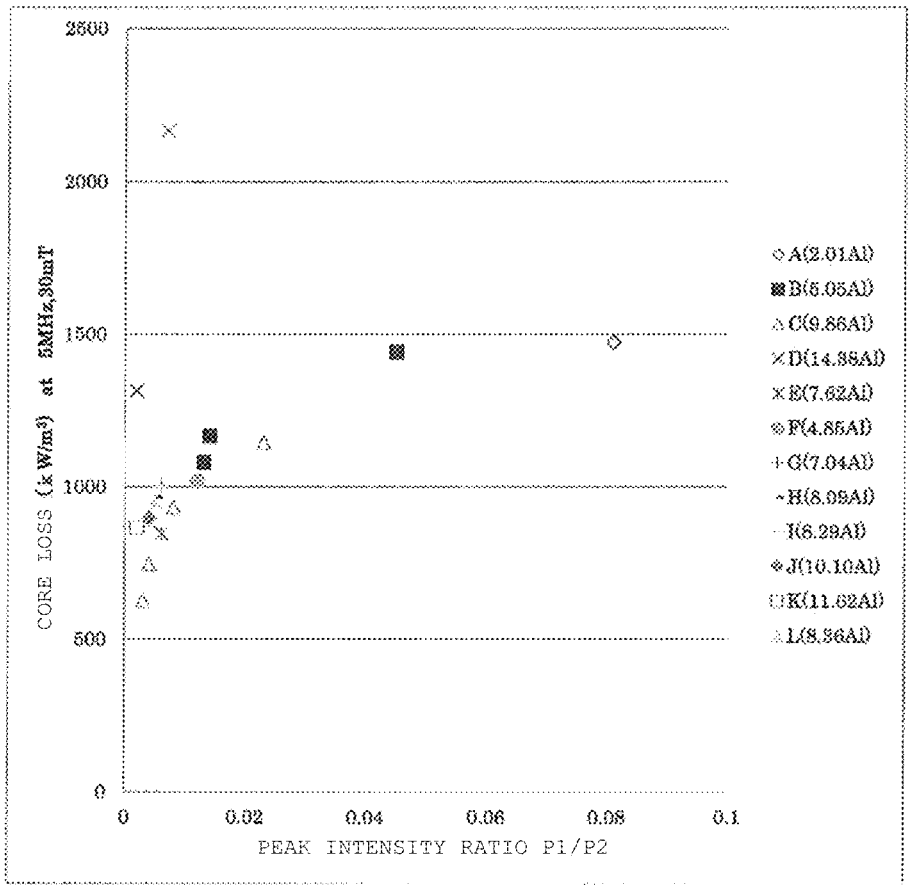
FIG. 7 is a plot view of a core loss (10 mT, 5 MHz, 25° C.) with respect to a peak intensity ratio of a magnetic core of each of Samples No. *1, No. *2, No. 4, No. *5, and No. *7 to No. *21 prepared in Examples.

Each of the magnetic cores prepared by the above steps was subjected to the following evaluations. The evaluation results are shown in Table 3. In Table 3, samples of Comparative Examples are distinguished by imparting * to Sample No. FIG. 3 shows the X-ray diffraction intensities of Samples No. 4 to No. *6, and FIG. 4 shows the X-ray diffraction intensity of Sample No. *7. FIG. 5A shows an SEM image of the cross section of the magnetic core of Sample No. 4, and FIGS. 5B to 5D show composition mapping images provided by EDX (Energy Dispersive X-ray Spectroscopy). FIG. 6 shows a plot diagram of the core loss (30 mT, 300 kHz, 25° C.) with respect to the peak intensity ratio of the magnetic core of each of Samples No. *1 to No. *21 prepared in Examples, and FIG. 7 shows a plot diagram of the core loss (10 mT, 5 MHz, 25° C.) with respect to the peak intensity ratio of the magnetic core of each of Samples No. *1 to No. *21 (excluding No. *3 and No. *6) produced in Examples.

A. Space factor Pf (Relative Density)

A density ds (kg/m$^3$) of the annular magnetic core was calculated from the size and mass of the annular magnetic core according to a volume weight method. The space factor (relative density) [%] of the magnetic core was calculated by dividing the density ds by the true density of each of the Fe-based alloys. The true density here is also the same as the true density used for calculating the saturation magnetic flux density Bs.

B. Specific Resistance ρv

A disc-shaped magnetic core is used as an object to be measured. After a conductive adhesive is applied to each of two opposing planes of the object to be measured, dried and solidified, the object to be measured is set between electrodes. A DC voltage of 100 V is applied by using an electrical resistance measuring apparatus (8340A, manufactured by ADC Co., Ltd.) to measure a resistance value R (Ω). The plane area A (m$^2$) and thickness t (m) of the object to be measured were measured, and specific resistance ρ (Ωm) was calculated according to the following formula.

$$\text{Specific Resistance } \rho v(\Omega\text{m}) = R \times (A/t)$$

The magnetic core had a representative size including an outer diameter of 13.5 mm and a height of 2.0 mm.

C. Radial Crushing Strength σr

Based on JIS Z2507, the circular magnetic core was used as an object to be measured. The object to be measured was disposed between platens of a tensile/compressive tester (Autograph AG-1, manufactured by Shimadzu Corporation) such that a load direction was a radial direction. A load was applied in the radial direction of the circular magnetic core to measure a maximum load P (N) at the time of breaking, and the radial crushing strength σr (MPa) was obtained from the following formula.

$$\text{Radial Crushing Strength } \sigma r(\text{MPa}) = P \times (D-d)/(I \times d^2)$$

[D: Outer Diameter of Magnetic Core (mm), d: Thickness of Magnetic Core [½ of Difference between Inner and Outer Diameters (mm), I: Height of Magnetic Core (mm)]

D. Core Loss Pcv

The circular magnetic core was used as an object to be measured. Each of a primary side winding wire and a secondary side winding wire was wound by 15 turns. The core loss Pcv (kW/m$^3$) was measured at room temperature on two conditions consisting of a maximum magnetic flux density of 30 mT and a frequency of 300 kHz, and a maximum magnetic flux density of 10 mT and a frequency of 5 MHz by using a B-H Analyzer SY-8232, manufactured by Iwatsu Test Instruments Corporation.

E. Initial Permeability μi

The circular magnetic core was used as an object to be measured. A conductive wire was wound by 30 turns, and the initial permeability was obtained according to the following formula from inductance measured at a frequency of 100 kHz at room temperature by an LCR meter (4284A, manufactured by Agilent Technologies Co., Ltd.).

$$\text{Initial Permeability } \mu i = (le \times L)/(\mu_0 \times Ae \times N^2)$$

(le: Magnetic Path Length, L: Inductance of Sample (H), $\mu_0$: Vacuum Permeability=$4\pi \times 10^{-7}$ (H/m), Ae: Cross Section of Magnetic Core, N: Winding Number of Coil)

F. Incremental Permeability μΔ

The circular magnetic core was used as an object to be measured. A conductive wire was wound by 30 turns to form a coil component. Inductance L was measured at a frequency of 100 kHz at room temperature by an LCR meter (4284A, manufactured by Agilent Technologies Co., Ltd.) in a state where a direct current magnetic field of up to 10 kA/m was applied by a direct current applying apparatus (42841A, manufactured by Hewlett Packard). From the obtained inductance, the incremental permeability μΔ was obtained as in the initial permeability μi.

G. Structure Observation and Composition Distribution

A toroidal-shaped magnetic core was cut, and the cut surface was observed by a scanning electron microscope (SEM/EDX: Scanning Electron Microscope/Energy Dispersive X-ray Spectroscopy) to perform element mapping (magnification: 2000 times).

H. X-Ray Diffraction Intensity Measurement

From a diffraction spectrum according to an X-ray diffraction method using an X-ray diffraction apparatus (Rigaku RINT-2000, manufactured by Rigaku Corporation), a peak intensity P1 of a diffraction peak of an Fe oxide having a corundum structure appearing in the vicinity of 2θ=33.2° and a peak intensity P2 of a diffraction peak of an Fe-based alloy having a bcc structure appearing in the vicinity of 2θ=44.7° were obtained, to calculate a peak intensity ratio (P1/P2). The condition for the X-ray diffraction intensity measurement included X-ray of Cu-Kα, an applied voltage of 40 kV, a current of 100 mA, a divergence slit of 1°, a scattering slit of 1°, a receiving slit of 0.3 mm, continuous scanning, a scanning speed of 2°/min, a scanning step of 0.02°, and a scanning range of 20 to 110°.

TABLE 3

| Sample No. | Raw material powder* | Heat treatment temperature (° C.) | Space factor (%) | Diffraction peak intensity P1 (104) | Diffraction peak intensity P2 (110) | Peak intensity ratio P1/P2 | $Fe_3Al$ phase | Core loss Pcv Condition 1 (30 mT, 300 kHz) ($kW/m^3$) |
|---|---|---|---|---|---|---|---|---|
| *1 | A (2.01) | 820 | 85.1 | 521 | 2364 | 0.220 | Absence | 870 |
| *9 | | 720 | 83.6 | 252 | 3107 | 0.081 | Absence | 775 |
| *10 | F (4.85) | 720 | 82.9 | 41 | 3434 | 0.012 | Absence | 573 |
| *11 | B (5.05) | 670 | 83.2 | 46 | 3436 | 0.013 | Absence | 588 |
| *12 | | 720 | 83.5 | 49 | 3419 | 0.014 | Absence | 558 |
| *2 | | 820 | 86.3 | 153 | 3428 | 0.045 | Absence | 434 |
| *3 | | 870 | 86.7 | 530 | 2244 | 0.236 | Absence | 577 |
| 13 | G (7.04) | 730 | 85.1 | 21 | 3304 | 0.006 | Absence | 361 |
| 8 | E (7.62) | 720 | 83.0 | 19 | 3277 | 0.006 | Absence | 422 |
| 14 | H (8.09) | 730 | 85.6 | 15 | 3209 | 0.005 | Absence | 350 |
| 15 | I (8.29) | 730 | 84.6 | 19 | 3258 | 0.006 | Absence | 342 |
| 16 | L (8.36) | 730 | 85.6 | 16 | 3219 | 0.005 | Absence | 354 |
| 17 | C (9.86) | 670 | 82.7 | 11 | 3663 | 0.003 | Absence | 399 |
| 18 | | 720 | 83.2 | 15 | 3427 | 0.004 | Absence | 404 |
| 4 | | 770 | 84.6 | 26 | 3395 | 0.008 | Absence | 378 |
| *5 | | 820 | 87.3 | 78 | 3406 | 0.023 | Absence | 385 |
| *6 | | 870 | 87.9 | 228 | 3098 | 0.074 | Absence | 1105 |
| 19 | J (10.10) | 730 | 85.0 | 14 | 3103 | 0.004 | Absence | 352 |
| 20 | K (11.62) | 730 | 83.1 | 7 | 3280 | 0.002 | Absence | 398 |
| *21 | D (14.38) | 670 | 83.4 | 9 | 3481 | 0.002 | Presence | 651 |
| *7 | | 770 | 85.4 | 23 | 3367 | 0.007 | Presence | 595 |

| Sample No. | Core loss Pcv Condition 2 (10 mT, 5 MHz) ($kW/m^3$) | μi 100 kHz | μΔ 10 kA/m | ρv (at 100 V) (kΩm) | Radial crushing strength (MPa) |
|---|---|---|---|---|---|
| *1 | 1788 | 29 | 21 | Insulation breakdown | 281 |
| *9 | 1474 | 35 | 23 | Insulation breakdown | 163 |
| *10 | 1020 | 38 | 23 | 47.26 | 149 |
| *11 | 1080 | 43 | 24 | 40.54 | 128 |
| *12 | 1167 | 44 | 24 | 44.64 | 158 |
| *2 | 1443 | 44 | 24 | 60.15 | 260 |
| *3 | 5077 | 40 | 22 | Insulation breakdown | 365 |
| 13 | 1005 | 49 | 23 | 19.94 | 186 |
| 8 | 848 | 46 | 23 | 48.27 | 153 |
| 14 | 967 | 51 | 23 | 16.16 | 187 |
| 15 | 1000 | 49 | 24 | 43.56 | 193 |
| 16 | 948 | 50 | 23 | 11.52 | 193 |
| 17 | 627 | 52 | 23 | 18.94 | 96 |
| 18 | 746 | 54 | 23 | 20.53 | 141 |
| 4 | 932 | 56 | 23 | 27.16 | 203 |
| *5 | 1147 | 52 | 23 | 69.67 | 265 |
| *6 | 19690 | 49 | 22 | Insulation breakdown | 339 |
| 19 | 896 | 55 | 22 | 7.46 | 189 |
| 20 | 867 | 49 | 21 | 18.61 | 166 |
| *21 | 1315 | 56 | 17 | 13.97 | 100 |
| *7 | 2168 | 59 | 18 | 13.23 | 197 |

*Numerical values in parentheses in raw material powder represent Al ratios.

In Samples No. 4, No. 8, and No. 13 to No. 20 as Examples, a peak intensity ratio (P1/P2) of the peak intensity P1 of the diffraction peak of the Fe oxide having a corundum structure appearing in the vicinity of 2θ=33.2° to the peak intensity P2 of the diffraction peak of the Fe-based alloy having a bcc structure appearing in the vicinity of 2θ=44.7° is 0.010 or less. Samples No. 4, No. 8, and No. 13 to No. 20 provide magnetic cores having a higher initial permeability, a smaller core loss, and a more excellent core loss at high frequencies than those of each of Samples No. *1 to *3, *5 to *7, *9 to *12, and *21 as Comparative Examples. Samples No. 4, No. 8, and No. 13 to No. 20 have larger specific resistance ρv and more excellent insulation properties. It was found that the above configuration according to Examples is extremely advantageous for obtaining excellent magnetic properties. The peak intensity ratio (P1/P2) can be set to 0.010 or less by controlling the composition of the raw material powder and the heat treatment temperature of the green compact. As the Al ratio in the composition of the raw material powder increases, or as the heat treatment temperature of the green compact decreases, the peak intensity ratio (P1/P2) tends to decrease. The peak intensity P2 was also the diffraction maximum intensity in the X-ray diffraction spectrum.

The X-ray diffraction spectrum of the sample using the raw material powder C shown in FIG. 3 also shows the X-ray diffraction spectrum of the green compact (not subjected to heat treatment). As shown therein, the Fe oxide is formed by the heat treatment, and the peak intensity of the diffraction peak of the Fe oxide having a corundum structure changes by the heat treatment temperature. That is, by adjusting the heat treatment temperature, the target peak intensity ratio (P1/P2) is obtained, and a magnetic core having excellent magnetic properties can be efficiently prepared.

The X-ray diffraction spectrum of Sample No. *7 using the raw material powder D is shown in FIG. 4. As can be seen in FIG. 4, it is found that the superlattice peaks of an $Fe_3Al$ ordered alloy appear in the vicinity of 2θ=27° and in the vicinity of 2θ=31°, whereby Sample No. *7 contains an $Fe_3Al$ ordered alloy. FIG. 4 also shows the spectrum of the green compact (not subjected to heat treatment), but the superlattice peak is not observed in the green compact, whereby the $Fe_3Al$ ordered alloy is considered to be generated by the heat treatment. Sample No. *7 had a peak intensity ratio (P1/P2) of 0.007, and had a high permeability. However, the presence of $Fe_3Al$ caused Sample No. *7 to have a higher core loss than that of each of the samples of Examples. The same results were also obtained for No. *21.

FIG. 5A shows the evaluation results of cross section observation using a scanning electron microscope (SEM) for the magnetic core of Sample No. 4, and FIGS. 5B to 5D show the evaluation results of distributions of constituent elements by EDX. FIGS. 5B to 5D show mappings respectively indicating the distributions of Fe (iron), O (oxygen), and Al (aluminum). A brighter color tone (looking white in the figures) represents a more target element. From FIG. 5B, Fe is found to be also present between the Fe-based alloy particles. From FIG. 5C, it is found that much oxygens are present between the Fe-based alloy particles to form an oxide, and the Fe-based alloy particles are bonded via the oxide. The oxide layer was confirmed to be also formed on the surface of the magnetic core. From FIG. 5D, the concentration of Al between particles (grain boundary) including the surface of alloy particles was confirmed to be remarkably higher than that of other non-ferrous metal. Also in the observation of other samples, the same structure as that of Sample No. 4 was confirmed to be exhibited.

DESCRIPTION OF REFERENCE SIGNS

1 magnetic core
3*a*, 3*b* flange portion
5 conductive wire winding portion
10 coil component
20 coil
25*a*, 25*b* end portion of coil
50*a*, 50*b* metal terminal

The invention claimed is:

1. A magnetic core comprising Fe-based alloy particles containing Al, wherein:

in an X-ray diffraction spectrum of the magnetic core measured using Cu-Kα characteristic X-rays, a peak intensity ratio (P1/P2) of a peak intensity P1 of a diffraction peak of an Fe oxide having a corundum structure appearing in a vicinity of 2θ=33.2° to a peak intensity P2 of a diffraction peak of the Fe-based alloy having a bcc structure appearing in a vicinity of 2θ=44.7° is 0.010 or less (excluding 0); and a superlattice peak intensity of an $Fe_3Al$ ordered structure is equal to or less than a noise level within a range of 2θ=20° to 40°.

2. The magnetic core according to claim 1, wherein the magnetic core has a core loss (30 mT, 300 kHz, 25° C.) of 430 kW/$m^3$ or less, a core loss (10 mT, 5 MHz, 25° C.) of 1100 kW/$m^3$ or less, and an initial permeability of 45 or more.

3. The magnetic core according to claim 1, wherein:

the Fe-based alloy is represented by a composition formula: aFebAlcCrdSi; and in mass %, a+b+c+d=100, 6≤b<13.8, 0≤c≤7, and 0≤d≤1 are satisfied.

4. The magnetic core according to claim 3, wherein 7≤b≤13.5 is satisfied in Al.

5. A coil component comprising the magnetic core according to claim 1 and a coil.

* * * * *